US006330736B1

(12) United States Patent
Cheng

(10) Patent No.: US 6,330,736 B1
(45) Date of Patent: Dec. 18, 2001

(54) BUCKLE JOINT

(75) Inventor: Koon-Ming Cheng, Taipei (TW)

(73) Assignee: Ruey Yuan Co., Ltd., Taipei (TW)

( * ) Notice: Subject to any disclaimer, the term of this patent is extended or adjusted under 35 U.S.C. 154(b) by 0 days.

(21) Appl. No.: 09/547,862

(22) Filed: Apr. 12, 2000

(30) Foreign Application Priority Data

Apr. 14, 1999 (TW) ..... 88205729 U

(51) Int. Cl.[7] ..... A44B 11/25
(52) U.S. Cl. ..... 24/656; 24/657; 24/658
(58) Field of Search ..... 24/656, 657, 658, 24/265 AL; 411/514, 522

(56) References Cited

U.S. PATENT DOCUMENTS 1,265,869 * 5/1918 Arkin ..... 24/657
3,984,191 * 10/1976 Doty ..... 24/656
3,990,113 * 11/1976 Coenen ..... 24/656
5,669,118 * 9/1997 Frano et al. ..... 24/265 AL
5,711,056 * 1/1998 Taguchi et al. ..... 24/656

* cited by examiner

*Primary Examiner*—Victor N. Sakran
(74) *Attorney, Agent, or Firm*—Dickstein Shapiro Morin & Oshinsky LLP

(57) ABSTRACT

A buckle joint includes a clasp member, a catch member, a latch member, and an urging member. The clasp member has a stud with an outer periphery formed with an annular groove. The catch member has a first through-hole, a first tongue portion projecting into the first through-hole, and a recess. The stud projects into the first through-hole. The first tongue portion engages releasably the annular groove. The latch member is mounted slidably in the recess, and has a second tongue portion projecting into the first through-hole for engaging releasably the annular groove. The latch member is slidable into and out of the first through-hole from the recess between a locking position, in which the second tongue portion engages the annular groove, and an unlocking position, in which the second tongue portion disengages the annular groove. The urging member is mounted in the recess for urging the latch member to move to the locking position.

8 Claims, 6 Drawing Sheets

BUCKLE JOINT

BACKGROUND OF THE INVENTION

1. Field of the Invention

This invention relates to a buckle joint which is adapted to be used for connecting a shoulder strap to a handbag.

2. Description of the Related Art

FIG. 1 illustrates a conventional buckle joint which connects a bag 4 to a shoulder strap 5. The buckle joint includes a holding seat 1 which is secured to the bag 4, a first connecting piece 2 which is connected to the holding seat 1 via a folded fabric sheet 10, a hook member 3 which hooks the first connecting piece 2, and a second connecting piece 31 interconnecting the hook member 3 and the shoulder strap 5. Since the bag 4 is hooked on the hook member 3, it can easily swing when the user is walking, thereby resulting in inconvenience.

SUMMARY OF THE INVENTION

Therefore, the object of the present invention is to provide a buckle joint that is capable of overcoming the aforementioned problem.

According to the present invention, a buckle joint comprises: a clasp member having a seat, and a stud projecting outwardly from the seat, the stud having an outer periphery with an annular groove formed therein; a catch member having top and bottom ends, a first through-hole formed therein adjacent to the bottom end and defined by a ring-shaped inner face, a circumferential first tongue portion projecting upwardly into the first through-hole from one side of the ring-shaped inner face adjacent to the bottom end, and a recess formed therein between the top end and the first through-hole, the stud projecting into the first through-hole, the first tongue portion engaging releasably the annular groove; a latch member mounted slidably in the recess of the catch member and having a second tongue portion projecting downwardly into the first through-hole of the catch member from another side of the ring-shaped inner face opposite to and aligned with the first tongue portion for engaging releasably the annular groove, the latch member being slidable into and out of the first through-hole from the recess of the catch member between a locking position, in which the second tongue portion engages the annular groove, and an unlocking position, in which the second tongue portion disengages the annular groove; and an urging member mounted in the recess of the catch member for urging the latch member to move to the locking position.

BRIEF DESCRIPTION OF THE DRAWINGS

In drawings which illustrate an embodiment of the invention.

DETAILED DESCRIPTION OF THE PREFERRED EMBODIMENT

Figure 1:
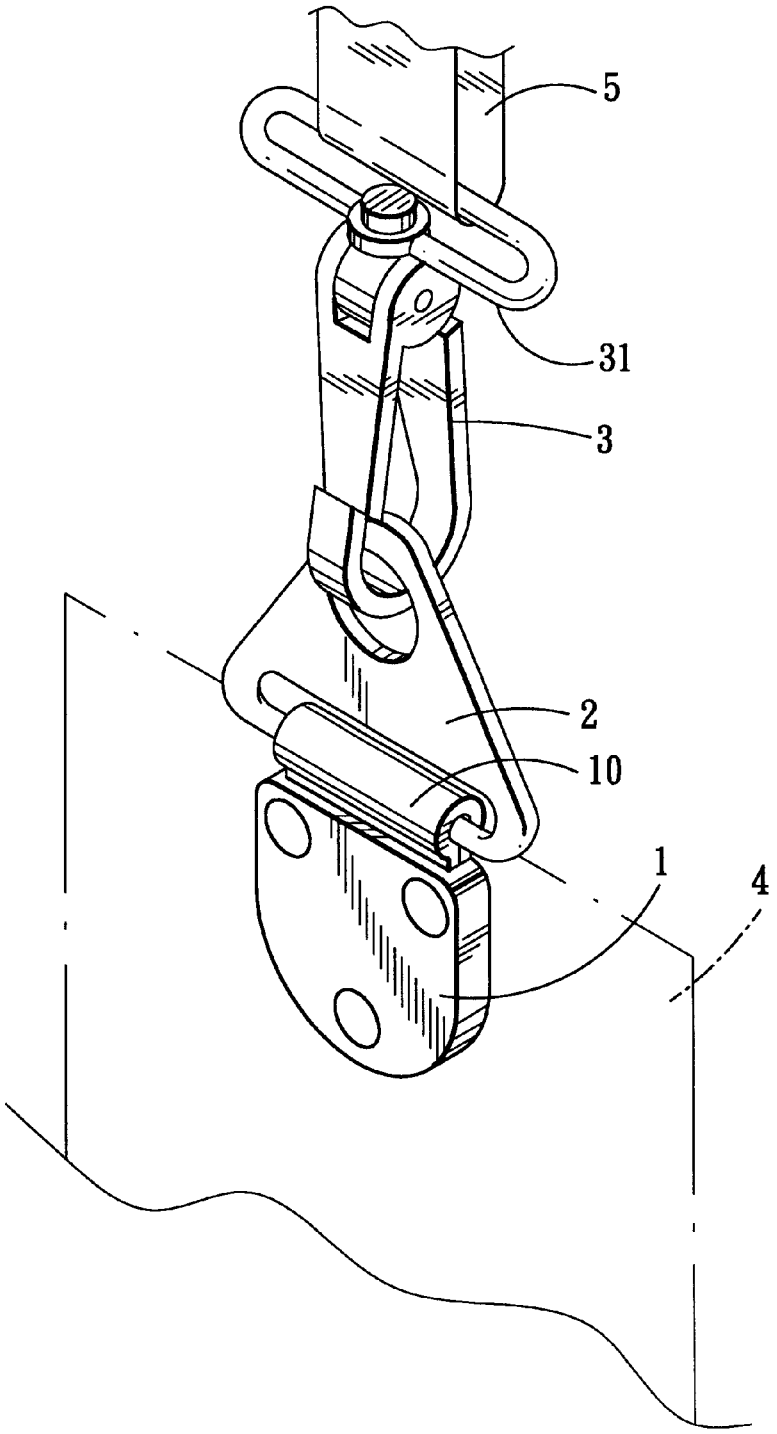
FIG. 1 PRIOR ART
FIG. 1 is a perspective view of a conventional buckle joint interconnecting a bag and a shoulder strap.
Figure 2:
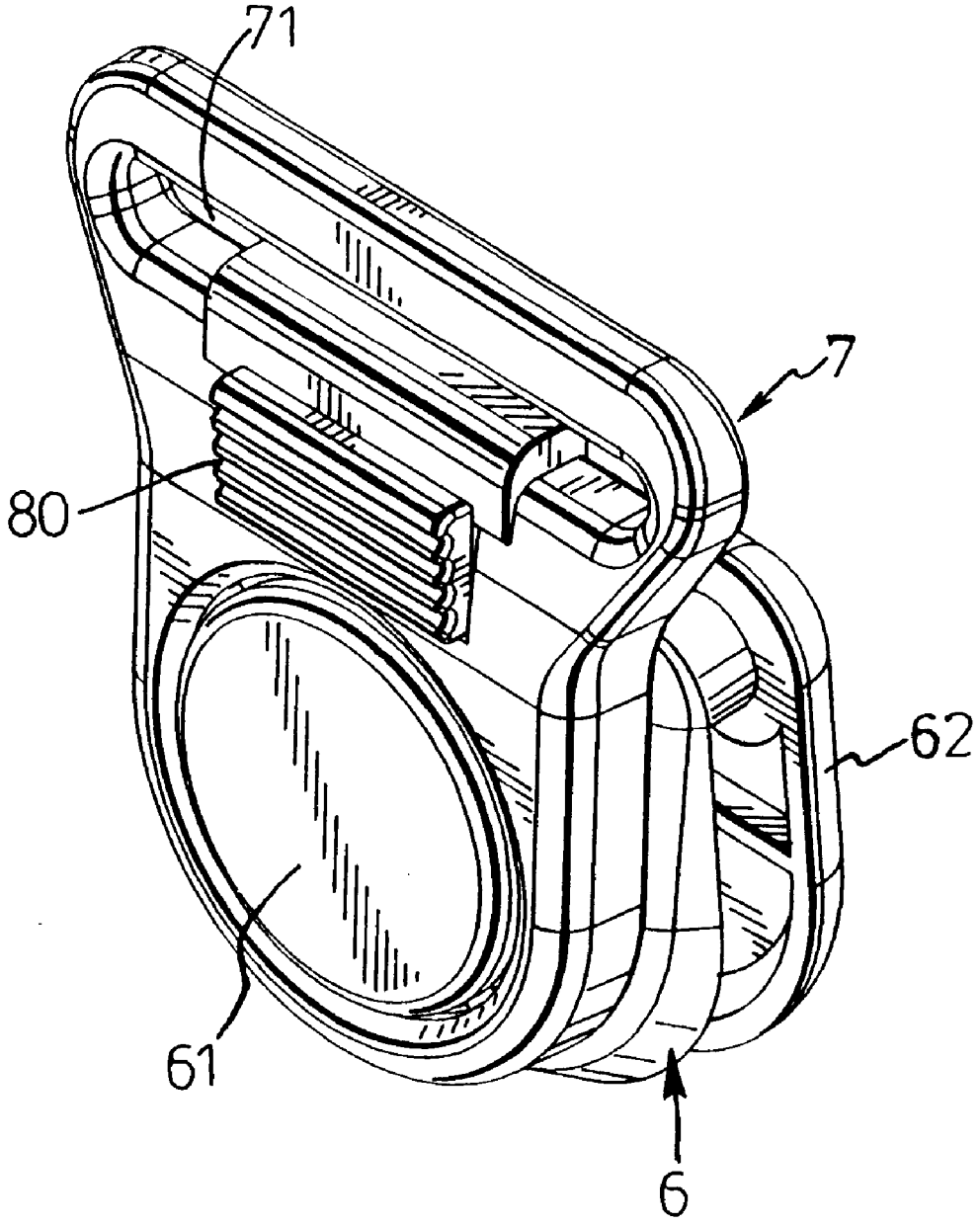
FIG. 2 is a perspective view of a buckle joint embodying this invention.
Figure 3:
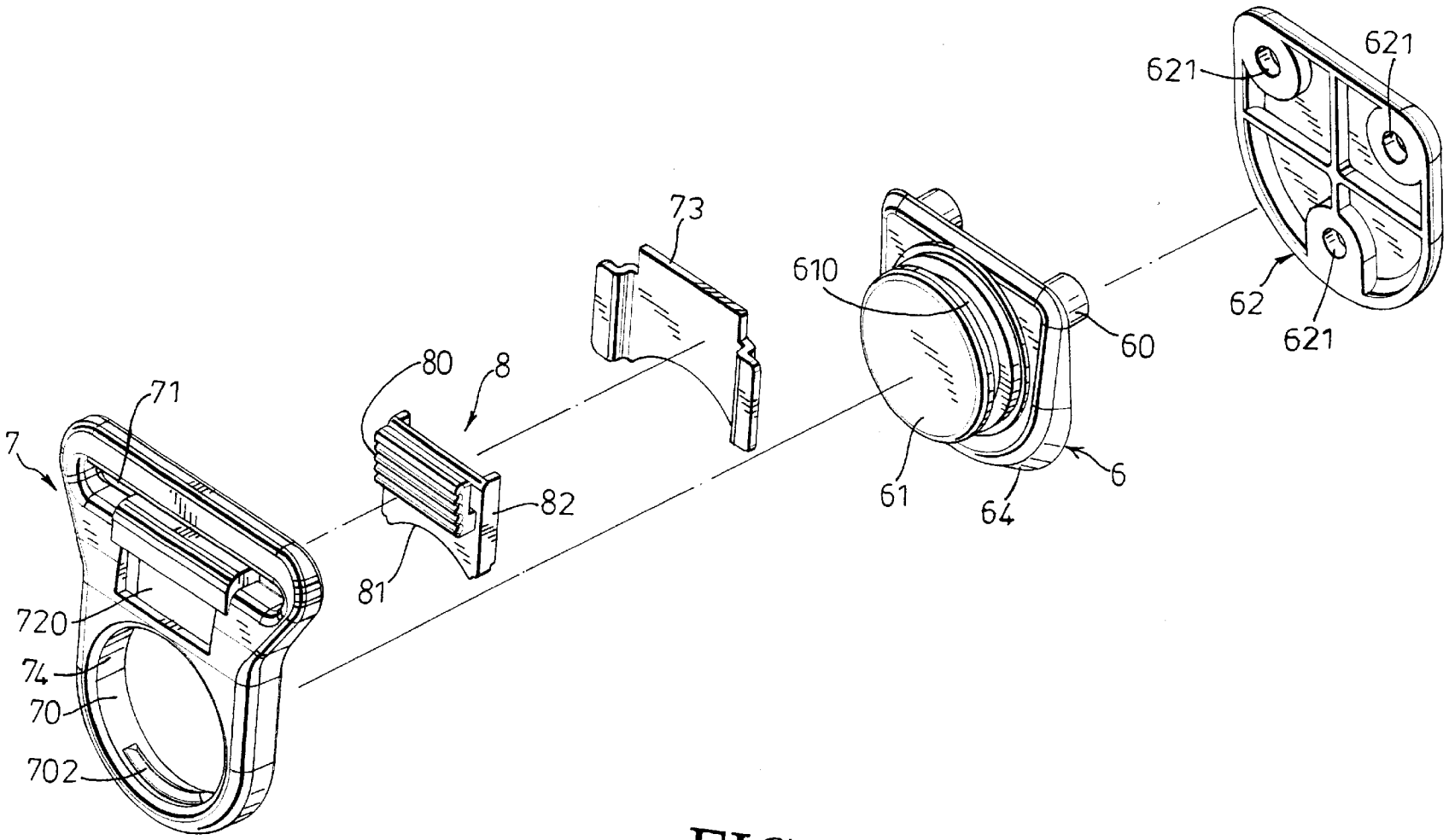
FIG. 3 is an exploded view of the buckle joint of FIG. 2.

FIGS. 2 and 3 illustrate a buckle joint embodying this invention. The buckle joint includes a clasp member 6, a catch member 7, a latch member 8, and an urging member 82.

Figure 4:
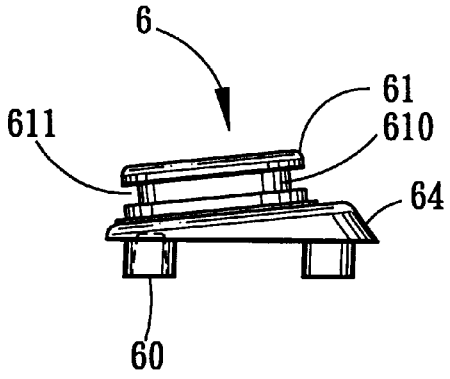
FIG. 4 is a side view of a clasp member of the buckle joint of FIG. 2.
Figure 5:
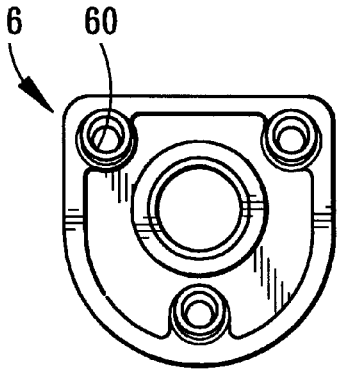
FIG. 5 is a bottom view of the clasp member of FIG. 4.
Figure 6:
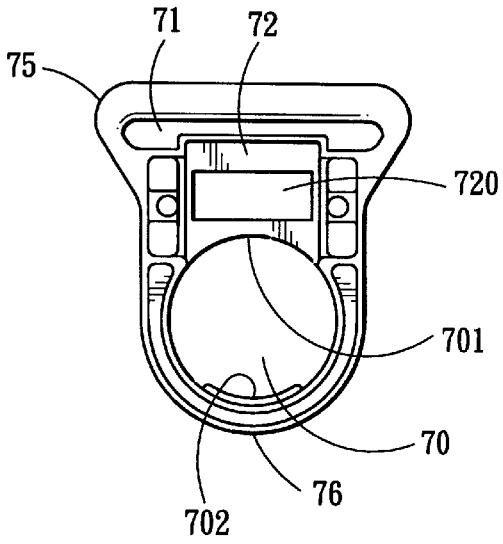
FIG. 6 is a rear view of a catch member of the buckle joint of FIG. 2.
Figure 7:
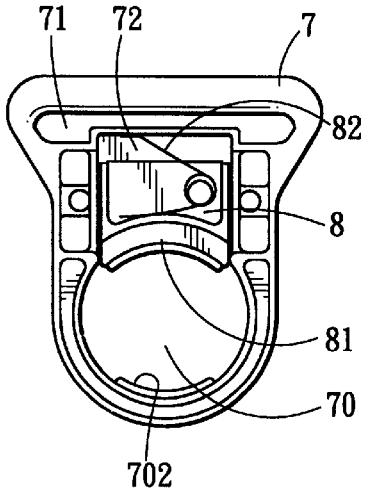
FIG. 7 is a rear view of the catch member of FIG. 6 with a latch member mounted thereon.
Figure 8:
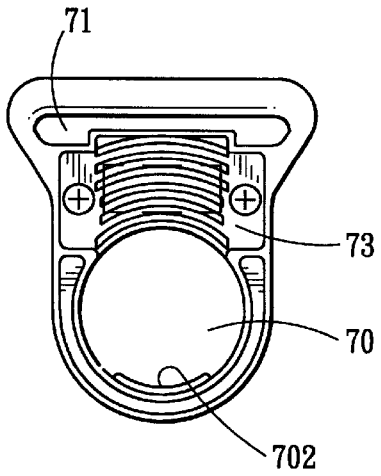
FIG. 8 is a rear view of the catch member of FIG. 6 with a cover secured thereto.

Referring now to FIGS. 4 and 5, in combination with FIGS. 2 and 3, the clasp member 6 includes a seat 64, a stud 61 projecting outwardly from one side of the seat 64, and a plurality of positioning sockets 60 projecting from the other side of the seat 64 in a direction opposite to the stud 61. The stud 61 has an outer periphery 610 with an annular groove 611 formed therein. A cap member 62 has a plurality of screw-holes 621 aligned respectively with the positioning sockets 60.

Referring now to FIGS. 6 to 9, in combination with FIGS. 2 to 5, the catch member 7 is formed as an integral thick plate, and has top and bottom ends 75, 76, a first through-hole 70 formed therein adjacent to the bottom end 76 and defined by a ring-shaped inner face 74, a recess 72 formed therein between the top end 75 and the first through-hole 70, a second through-hole 720 formed therein between the top end 75 and the first through-hole 70 within the recess 72, and an elongated third through-hole 71 formed therein between the top end 75 and the second through-hole 720. The stud 61 projects into the first through-hole 70. A circumferential first tongue portion 702 projects upwardly into the first through-hole 70 from one side of the ring-shaped inner face 74 adjacent to the bottom end 76, and engages releasably the annular groove 611.

The latch member 8 is in the form of a latch plate 82, and has a bottom end portion that defines a second tongue portion 81, and a pulling tab 80 projecting from the latch plate 82. The latch member 8 is mounted slidably in the recess 72. The second tongue portion 81 projects downwardly into the first through-hole 70 from another side of the ring-shaped inner face 74 opposite to and aligned with the first tongue portion 702 for engaging releasably the annular groove 611. The pulling tab 80 projects through the recess 72 and the second through-hole 720 for manipulation so that the latch member 8 is slidable into and out of the first through-hole 70 from the recess 72 between a locking position, in which the second tongue portion 81 engages the annular groove 611, and an unlocking position, in which the second tongue portion 81 disengages the annular groove 611. An urging member 82, which is in the form of a torsion spring, is mounted in the recess 72, and has two opposite ends abutting respectively against the latch member 8 and the catch member 7 so as to urge the latch member 8 to move to the locking position.

Since the first and second tongue portions 702, 81 engage slidably the annular groove 611, the catch member 7 is thus rotatable about the stud 61 when the latch member 8 is in the locking position.

Figure 9:
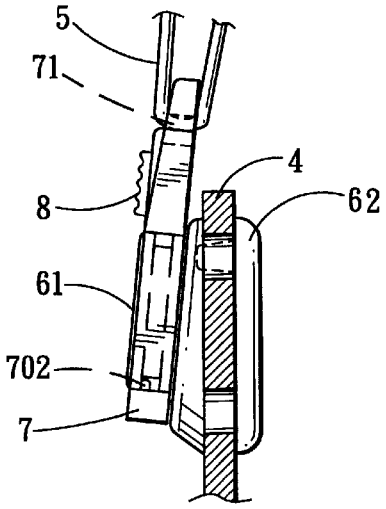
FIG. 9 is a partly cross-sectional side view of the buckle joint of FIG. 2 interconnecting a bag and a shoulder strap.

As illustrated in FIG. 9, the buckle joint of this invention can be used to interconnect a bag 4 and a shoulder strap 5. The shoulder strap 5 extends through the third through-hole 71. The bag 4 is fixed between the cap member 62 and the clasp member 6 by screw means extending through the screw-holes 621 and the positioning sockets 60. With the use of the buckle joint of this invention, swinging of the bag 4 can be minimized when the user is walking.

Preferably, a cover 73 is secured to the catch member 7 for covering the recess 72 and for retaining the urging member 8 in the recess 72.

With the invention thus explained, it is apparent that various modifications and variations can be made without departing from the spirit of the present invention. It is therefore intended that the invention be limited only as recited in the appended claims.

I claim:

1. A buckle joint, comprising:

a clasp member having a seat, and a stud projecting outwardly from said seat, said stud having an outer periphery with an annular groove formed therein;

a catch member having top and bottom ends, a first through-hole formed therein adjacent to said bottom end and defined by a ring-shaped inner face, a circumferential first tongue portion projecting upwardly into said first through-hole from one side of said ring-shaped inner face adjacent to said bottom end, and a recess formed therein between said top end and said first through-hole, said stud projecting into said first through-hole, said first tongue portion engaging releasably said annular groove;

a latch member mounted slidably in said recess of said catch member and having a second tongue portion projecting downwardly into said first through-hole of said catch member from another side of said ring-shaped inner face opposite to and aligned with said first tongue portion for engaging releasably said annular groove, said latch member being slidable into and out of said first through-hole from said recess of said catch member between a locking position, in which said second tongue portion engages said annular groove, and an unlocking position, in which said second tongue portion disengages said annular groove; and an urging member mounted in said recess of said catch member for urging said latch member to move to said locking position.

2. The buckle joint of claim 1, wherein said catch member is rotatable about said stud when said latch member is in said locking position.

3. The buckle joint of claim 1, wherein said latch member includes a latch plate which is mounted slidably in said recess of said catch member and which has a bottom end portion that defines said second tongue portion.

4. The buckle joint of claim 3, wherein said catch member is formed as an integral thick plate and further has a second through-hole that is formed between said top end and said first through-hole within said recess.

5. The buckle joint of claim 4, wherein said catch member further has an elongated third through-hole formed between said top end and said second through-hole.

6. The buckle joint of claim 5, wherein said catch member further has a cover fixed to said thick plate for covering said recess and for retaining said urging member.

7. The buckle joint of claim 4, wherein said latch member further includes a pulling tab projecting from said latch plate and extending out of said recess through said second through-hole.

8. The buckle joint of claim 1, wherein said urging member includes a torsion spring which has two opposite ends that abut respectively against said catch member and said latch member.

* * * * *